US009545156B2

(12) United States Patent
Mendi et al.

(10) Patent No.: US 9,545,156 B2
(45) Date of Patent: Jan. 17, 2017

(54) ENHANCED MATTRESS

(71) Applicants: Ronen Yechiel Mendi, Hadera (IL); Ronen Tuchfeld, Post Hefer (IL)

(72) Inventors: Ronen Yechiel Mendi, Hadera (IL); Ronen Tuchfeld, Post Hefer (IL)

( * ) Notice: Subject to any disclaimer, the term of this patent is extended or adjusted under 35 U.S.C. 154(b) by 0 days.

(21) Appl. No.: 14/305,569

(22) Filed: Jun. 16, 2014

(65) Prior Publication Data

US 2015/0173521 A1 Jun. 25, 2015

(51) Int. Cl.

| | |
|---|---|
| ***A47C 20/02*** | (2006.01) |
| ***A47C 27/00*** | (2006.01) |
| ***A47C 27/14*** | (2006.01) |
| ***A47C 27/18*** | (2006.01) |
| ***A61G 7/05*** | (2006.01) |

(52) U.S. Cl.

CPC ..... *A47C 20/026* (2013.01); *A47C 27/001* (2013.01); *A47C 27/148* (2013.01); *A47C 27/18* (2013.01); *A61G 7/05* (2013.01)

(58) Field of Classification Search

CPC ... A47C 20/026; A47C 27/001; A47C 27/148; A47C 27/18; A47C 20/025; A47C 27/00; A47C 27/14; A47C 27/142; A47C 27/144; A47C 27/146; A61G 7/05

See application file for complete search history.

(56) References Cited

U.S. PATENT DOCUMENTS

| | | | | |
|---|---|---|---|---|
| 3,885,258 A | | 5/1975 | Regan | |
| 4,473,913 A | | 10/1984 | Ylvisaker | |
| 4,665,573 A | | 5/1987 | Fiore | |
| 4,972,535 A | | 11/1990 | Goldman | |
| 4,982,466 A | | 1/1991 | Higgins et al. | |
| 4,989,591 A | | 2/1991 | Anders | |
| 5,025,519 A | * | 6/1991 | Spann et al. | 5/730 |
| 5,054,142 A | * | 10/1991 | Owens | 5/633 |
| 5,070,559 A | | 12/1991 | Pettifer | |
| 5,086,529 A | | 2/1992 | DeGroot | |
| 5,129,115 A | | 7/1992 | Higgins et al. | |
| 5,426,798 A | | 6/1995 | Guarino | |
| 5,509,153 A | | 4/1996 | Roschacher | |
| 5,604,021 A | | 2/1997 | Wagner | |

(Continued)

FOREIGN PATENT DOCUMENTS

| | | |
|---|---|---|
| JP | 2004089697 | 3/2004 |
| RU | 2240765 | 11/2004 |
| WO | 03105634 | 12/2003 |

OTHER PUBLICATIONS adjacent. (n.d.) American Heritage® Dictionary of the English Language, Fifth Edition. (2011). Retrieved Mar. 25, 2016 fromhttp://www.thefreedictionary.com/adjacent.*

*Primary Examiner* — David E Sosnowski
*Assistant Examiner* — Amanda L Miller
(74) *Attorney, Agent, or Firm* — Avery N. Goldstein; Blue Filament Law PLLC

(57) ABSTRACT

An enhanced mattress for enabling passive involuntary digestive tract movement, shoulder opening and pelvis bones movement. The apparatus is configured solely for prone lying of a human body thereupon and includes a head support section which comprises an open face section, an upper main section connected to the head support section, the upper main section comprises a plurality of dedicated supporting members. A lower support section connected to the upper main section.

15 Claims, 5 Drawing Sheets

(56) References Cited

U.S. PATENT DOCUMENTS

| | | | | |
|---|---|---|---|---|
| 5,774,916 | A | 7/1998 | Kurhi | |
| 5,819,348 | A | 10/1998 | Ryan | |
| 6,154,903 | A | 12/2000 | Wai-Chung | |
| 6,324,710 | B1 | 12/2001 | Hernandez et al. | |
| 6,585,328 | B1 | 7/2003 | Oexman et al. | |
| 6,691,354 | B1 | 2/2004 | Sheppard | |
| 6,739,008 | B1 * | 5/2004 | Kindrick | A47C 7/021 5/655.9 |
| 7,020,918 | B1 | 4/2006 | Tinsley | |
| 7,065,816 | B2 | 6/2006 | McGettigan | |
| 7,065,817 | B2 | 6/2006 | Shield | |
| 8,011,047 | B2 | 9/2011 | Mandelzis et al. | |
| 2004/0007008 | A1 | 1/2004 | Benatav | |
| 2004/0074007 | A1 * | 4/2004 | Gladney | A47C 27/20 5/727 |
| 2005/0283104 | A1 | 12/2005 | Abelbeck | |
| 2008/0201860 | A1 * | 8/2008 | Malzl | 5/727 |
| 2009/0320208 | A1 * | 12/2009 | Mandelzis et al. | 5/632 |
| 2012/0272457 | A1 * | 11/2012 | Allman et al. | 5/716 |
| 2014/0041122 | A1 * | 2/2014 | Haworth et al. | 5/632 |
| 2015/0282635 | A1 * | 10/2015 | Rawls-Meehan | A47C 7/027 5/722 |

* cited by examiner

Section A-A

Section A-A

ENHANCED MATTRESS

RELATED APPLICATION

This application claims priority under 35 U.S.C. §119 or 365 to Israel, Application No. 230109, filed Dec. 23, 2013. The entire teachings of the above application(s) are incorporated herein by reference.

FIELD AND BACKGROUND OF THE INVENTION

The subject matter of the current application relates to mattresses. Embodiments of the current invention are related to digestion and to improved performance of back and chest tissue and skeleton, spine vertebra and disks flexible movement and functioning. This is further enhanced by offloading nerves system for better control and functioning, allowing deep breathing and as resulted of the abovementioned better rest and relaxation and avoiding mental stress. More specifically, embodiments of the present invention relate to apparatuses and methods of body relaxation and enabling involuntary digestive tract movement.

Pelvis Bones motion, stability and flexibility. Pelvis is constructed of 3 main bones, 2 Ilium bones, and 1 sacrum bone constructed of 5 bones. All together enable harmonious motion and stability and flexibility while walking. Due to long stress usually due to sitting and other activities there is a need for stress release of the pelvic system that will enable to regenerate the stability and better support of the spine and the hip joints. The new apparatus member 16 material strength allows the pelvis floating and release.

In the specification and claims which follow hereinbelow, the term "mattress" is intended to mean a device used for lying face down, (i.e. "prone") especially to support and relax the back, shoulders, neck, and abdomen. As such, the terms "cushion", and "pillow" may be used interchangeably and/or as components of "mattress" hereinbelow. Additionally, the term "digestive tract", as used hereinbelow in the specification and claims, is intended to mean one or all of the bodily organs and their functionality, beginning with the stomach and to the small and large intestines, and rectum—as well as other organs and tissues associated with these bodily organs.

The terms "gut" and "abdomen", and other related terms are included in the definition of "digestive tract". The word "movement", when used in the expression "digestive tract movement" is intended to mean a sensation of being massaged in the abdomen and/or a physiological increase in functionality of the digestive tract.

The expression "shoulder opening" is intended to mean in the specification and claims hereinbelow the act of gently supporting both shoulders when lying in a prone position so that both shoulders are biased backwards (i.e. towards the back), as further described hereinbelow.

The term "poor breathing", as used in the specification and claims herein below is intended to mean reduced utilization of lung capacity/breathing capacity, typically expressed in shallow breathing, as further described hereinbelow.

The majority of the population nowadays starting at a relatively young age suffers from pressure on the spinal system due to modern lifestyles and/or from stress due to over and under activity. Lower back pain, inflammation, disc anomalies in example change in size and structure, vertebrae subluxation, pressure on nerves, vertebrae pressure on discs, ruptured disc, and wear and tear on vertebrae and disc may appear as a result of stress on the spinal system. This stress comes about by a number of root causes such as, but not limited to: over weightiness, prolonged sitting; pregnancy; obesity; lack of physical activity; atrophy of ligaments and muscles; professional sports activity; driving; and even sleeping on a non-suitable surface.

In many cases—although not necessarily from the same sources—poor spinal health may be accompanied with poor digestive tract health and poor breathing, as described hereinbelow.

There are a number of characteristics of modern life that contribute to poor digestive tract health (also referred to as poor "abdominal health" hereinbelow) and poor breathing, due mostly to our daily, prolonged sitting at a desk and while sitting while driving and commuting, for example. In such sitting positions, the rib cage is additionally affected by slouching of the shoulders towards the chest, creating stress, and pressure on the rib cage, on the back of the neck, and upon the upper back. Additionally, prolonged sitting contributes to poor breathing.

There are disadvantages in currently-available methods to address slouching and back relief/release including: substantial expense of certain treatments; and various devices that place force on the back and/or necessitate judgment on the part of the therapist or the patient regarding operation of the device intended to alleviate or reduce pressure on the spinal system.

Another source of poor abdominal health is of poor nutrition. Poor nutrition can be the result of consuming an unbalanced diet characterized by: processed food; fast food, gluten-rich food; and processed meat and milk products. Prolonged sitting and/or insufficient movement and/or poor breathing as described hereinabove can additionally create irregularity of intestinal functioning and constipation. There are disadvantages in currently-available methods used to address intestinal under-activity or over-activity by chemical or invasive treatments such as enema and/or medications.

Additionally, insufficient sleep contributes to poor abdominal health. Insufficient and interrupted sleeping/resting/relaxation characterizes another aspect of our modern life—however this is not a normal situation for the human body. The importance of a sufficient number of hours' sleep each night is well-documented; however most people today simply are not able to or do not sleep enough. With insufficient sleep, the mind cannot completely perform the control function necessary to relax the body. Sleep and rest have a strong influence on our quality of life and life expectancy, as well as our productivity, in general. Any apparatus and/or method to encourage relaxation and a resultant deeper and longer sleep are desirable.

There is therefore a need to address the characteristic problems associated with modern work and lifestyles that involve, inter alia, prolonged sitting, as noted hereinabove. Additionally, subluxation can be in the body for long periods of time before creating any signs and or symptoms of disease, malfunction, disability and/or pain.

In addition to the problems of poor abdominal health, nutrition, lack of sleep and prolonged sitting noted above, many people generally disregard and don't take care of the mobility and alignment of the spine vertebrae. Loss of mobility of the spinal vertebrae may cause limited range of motion, limited flexibility, upper back pain, lower back pain, neck pain, and poor breathing, intestinal tract malfunction, stomach pain, intestinal inflammation, constipation, and other digestive problems.

Prior art addressing the problems listed hereinabove includes: pharmaceutical remedies; dietary programs; electromechanical contraptions; and passive apparatuses. Each proposed solution respectively claims some success—be it therapeutic or preventative. Regarding a passive apparatus, there are those having patient-specific conformal shapes and those available to the public. Among apparatuses applicable to public are included, but not limited to: pillows; neck supports; cushions; mattresses; back braces; girdles; and combinations thereof.

There are a range of prior art solutions such as shaped mattresses and supports for the spine, which have been developed to ease spinal stress by supporting certain tissues or other parts of the back. Mechanical and electromechanical solutions involve implementation of force and rapid movements, causing traction and mobility of the back in whole or part. These solutions have typically focused on areas of the lower back and lower vertebrae of the lumbar spinal column.

Typically, most of these devices work while the person lies on his back (i.e. a supine position) which constrains movement and relaxation of the back as well as the other skeleton parts, such as the pelvis and shoulder girdle—while a force is applied, locally blocking global system improvement.

Additionally, when a person lies on his back, the weight of the digestive tract falls on the spinal column. Lying in a supine position can serve to impede any possible correction to subluxation and or other spinal system problems, if present.

In the field of mattresses, there are a limited set of combinations; derived by respectively relating to the head, neck, torso, abdomen, and pelvis. Nevertheless, since mattresses are certainly not a new art, there are many specialized variations that appear in the patent literature. Examples (in approximate order of relevance) include US 2005/0283104; U.S. Pat. Nos. 6,154,903; 6,691,354; 7,020,918; 6,324,710; 5,086,529; 4,665,573; 4,473,913; 5,509,153; 4,989,591; 5,070,559; 5,426,798; 5,774,916; 5,025,519; US 2004/007008; U.S. Pat. Nos. 4,982,466 and 5,129,115; U.S. Pat. No. 5,604,021; RU 2240765; U.S. Pat. Nos. 3,885,258; 4,972,535; 6,585,328; and in the sub-category related to adaptations for pregnant women U.S. Pat. Nos. 5,819,348; 7,065,817; 7,065,816; WO 03105634; and JP 2004089697—all incorporated by reference.

Additionally, in U.S. Pat. No. 8,011,047 by Mendelzis et al.—the inventors of the current patent application—disclose a spinal-length mattress including a means for providing buoyancy to a human torso and abdomen thereon; attached to the mattress at one end, a pelvic support portion; and attached to the mattress at an opposite end, a head rotation stabilization portion having an air passage opening allowing a person to breathe freely when resting in a face down position thereon. By supporting the pelvis and stabilizing the head to substantially limit motions of the neck, a central cushion (preferably dominated by a "shape memory foam" filling) allows the spinal column to passively distribute all directional stresses-including those deriving from body mass and from muscle tension. Thus relieved of stress, disks between spinal bones begin to return to their respective naturally compliant symmetrical shapes; thereby generally providing a long term benefit for 15-30 minutes of regular use of the mattress.

In the '047 patent, Mandelzis et al. disclose a general mattress structure and mention the advantages of a so-called DBU Method defined as lying on the mattress structure for 15-20 minutes a day 1 or 2 times a day. No detailed specification nor description of DBU is given in the '047 patent. Furthermore, the mattress structure is directed primarily to spinal relaxation (i.e. patent title "Spinal Relaxation Apparatus") and the mattress structure is not directed to any other part of the body.

There is therefore a need for an apparatus that can passively address problems related to loss of mobility of the spinal vertebrae, which can additionally address upper back pain, lower back pain, neck pain, and poor breathing, in addition to intestinal tract malfunction, stomach pain, intestinal inflammation, constipation, and other digestive tract problems.

SUMMARY OF THE INVENTION

According to the teachings of the present invention there is provided an enhanced mattress configured for enabling passive involuntary digestive tract movement, shoulder opening and pelvis bones movement, the mattress being configured solely for prone lying of a human body thereupon and includes:

a head support section configured to support a head of the human body, the head support section includes an open face section;

an upper main section connected to the head support section, the upper main section configured to support shoulders and an abdomen of the human body, the upper main section includes a plurality of dedicated supporting members, each of which is smaller than the upper main section and has a greater firmness therefrom;

a lower support section connected to the upper main section, the lower support section configured to support a pelvis of the human body.

Any of the following features, either alone or in combination, may be applicable to any of the above aspects of the subject matter of the application:

The sections can form a substantially continuous mattress.

The plurality of dedicated supporting members can include: two shoulder supporting members; a first intestinal supporting member; and a second intestinal supporting member.

The shoulder supporting members can be positioned to correspond with the shoulders, the shoulder supporting members configured to bias the shoulders backwards, in a direction away from the mattress.

The first intestinal supporting member can be positioned to compress and correspond with a stomach and small and large intestine area of the body, and the second intestinal support member can be positioned to compress and correspond with an ICV in the large intestine area of the body.

The first intestinal supporting member can be located diagonally opposite the second intestinal support member in the upper main section.

The first intestinal support member can be configured to support and press the stomach area and the transverse intestine curve to the descending intestine and to create a full stomach sensation, and induce a positive intestinal movement in a circular clockwise direction, the second intestinal support member can be configured to induce a positive intestinal movement in a circular clockwise direction.

The head support section and lower support section can be fabricated from foam having a density ranging substantially from 30-40 kg/cubic meter.

The head support section and the lower support section can be fabricated from an inflatable, strong, flexible plastic material.

The upper main section can be fabricated from visco-elastic memory foam having a density ranging substantially from 60-80 kg/cubic meter.

The supporting members can have a density of 30-40 kg/cubic meter.

The supporting members can have a polygonal shape.

The lower support section can have a greater firmness than the upper main section.

A base section can be positioned beneath, and configured to support, the upper main section.

The base section can be fabricated from foam having a density ranging substantially from 30-40 kg/cubic meter.

The head support section can include two cushioning members located at each side of the head opening, the cushioning members can extend away from the upper main section.

The base support section can include a relief member which has a lower firmness than the rest of the base support section, the relief member can be located at the middle of the base support section in a width direction.

The relief member can be made of a visco-elastic material.

BRIEF DESCRIPTION OF THE DRAWINGS

The invention is herein described, by way of example only, with reference to the accompanying drawings, wherein.

DETAILED DESCRIPTION OF THE PREFERRED EMBODIMENTS

Figure 1:
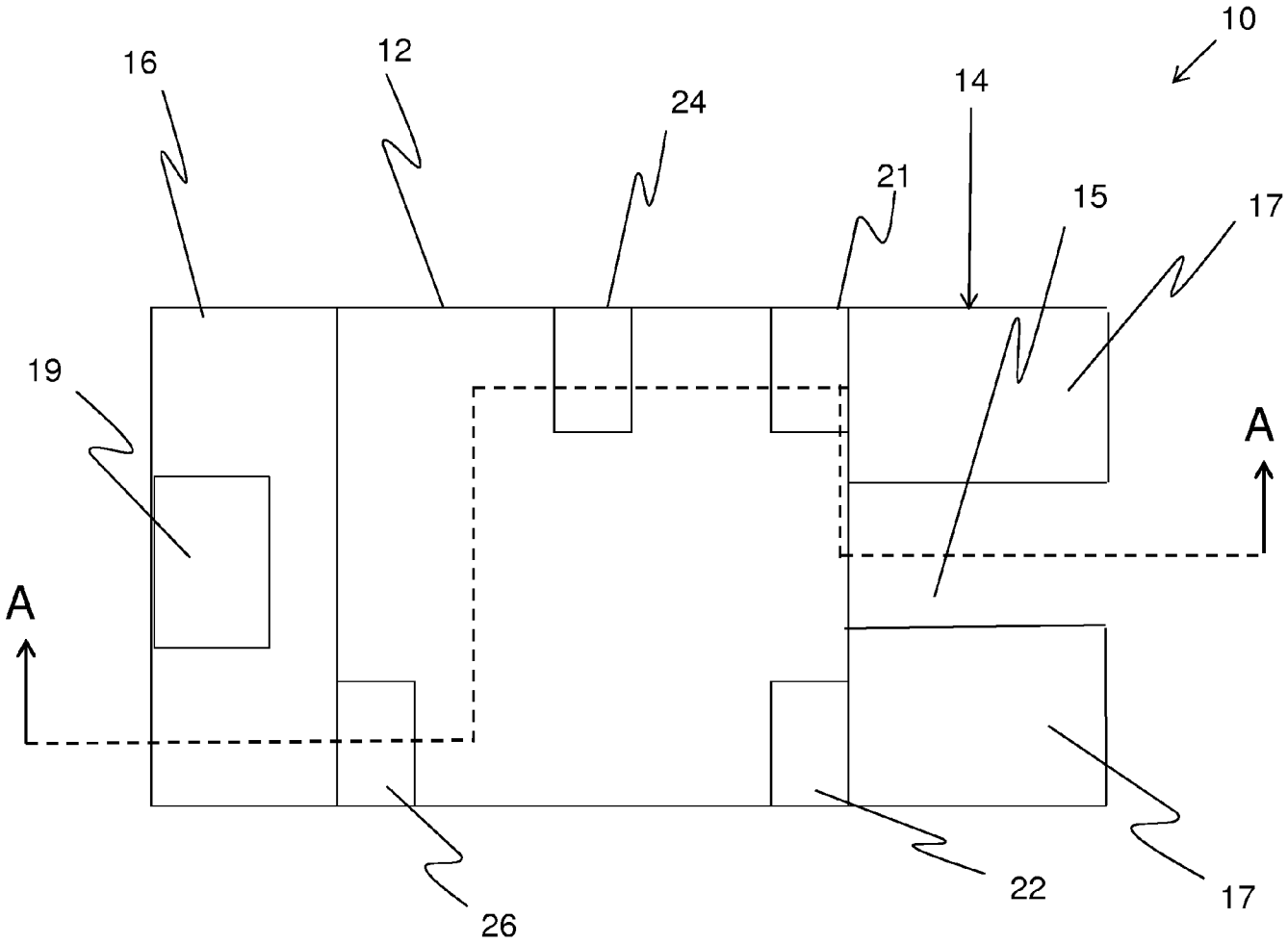
FIG. 1 is a plan view of a mattress for activating passive involuntary digestive tract movement.

Embodiments of the current invention are related to digestion and to overall health. More specifically, embodiments of the present invention relate to a mattress and method for activating passive involuntary digestive tract movement and for shoulder opening Reference is currently made to FIG. 1, which is a plan view of a mattress for activating passive involuntary digestive tract movement 10, and to FIG. 2, which is a sectional elevation view of the mattress shown in FIG. 1, in accordance with embodiments of the current invention. The mattress 10 has a special geometry to support the chest and the face in a face-down ("prone") position, as described hereinbelow.

The mattress 10 includes: an upper main section 12; a head support section 14; an open face section 15; a lower support section 16; and a base section 18. Imbedded within main section 12 are a plurality of dedicated supporting members including: shoulder supporting members 21 and 22; a first intestinal supporting member 24; and a second intestinal supporting member 26. The first and second supporting members are also known and referred to herein as compressing members. The head support section 14 includes two cushioning members 17 located at each side of the open face section 15. The cushioning members 17 extend away from the upper main section 12. The cushioning members 17 support a person's face when supported in the head support section 14, face down. The open face section 15 allows a clear breathing space near the person's face. Dedicated supporting members 21, 22, 24, and 26 are examples of supporting members imbedded within upper main section 12; and additional and/or option members may be configured within the upper main section, as described further hereinbelow. The supporting members 21, 22, 24, and 26 can be fabricated from a sponge like material, which has a greater firmness than the upper main section 12. In other words, the supporting members 21, 22, 24, and 26 are configured to apply a greater reaction force than the upper main section 12. The supporting members 21, 22, 24, and 26, e.g., can have a density of 30-40 kg/cubic meter. The supporting members 21, 22, 24, and 26 can have any desired shape, e.g., a box shape, or a cylindrical shape and each is smaller in volume (and any other dimension) than any of the other parts of the apparatus 10. In other words, the supporting members 21, 22, 24, and 26 can have, e.g., the following box dimensions: length->10-15 cm; width->5-15 cm; depth->2.5-4 cm. The supporting members 21, 22, 24, and 26 can protrude out of, or they can be at least at the same level as, the upper main section 12. The supporting members 21, 22, 24, and 26 are preferably not sunk below an outer, top surface 13 of the upper main section 12.

Lower support section 16 serves to support the person's pelvis. Base support section 18 acts to support the upper main section, All of the sections and members noted hereinabove are mechanically connected/integrated and are additionally covered (connections and covering not shown in the figures) to yield one nearly-continuous/integrated mattress structure.

According to an embodiment of the present application, the base support section can include a relief member 19 which has a lower firmness than the rest of the base support section. The relief member is preferably made form a visco-elastic material, or memory foam.

The mattress 10 enables and a proper support and flexibility of the pubic joint to move. This lower support section 16 gives the proper support to both Iliums (pelvis bones) which are located on the 2 sides of the pelvis, while providing (via the relief member 19) a softer support, which enables floating, balance and proper minimal motion in the center and avoid pressure on the sex organs, where the pubic joint is located. The relief member 19 enables proper support of the pubic joint. The abdominal breathing creates pressure that allows the minimal motion of the pubic joint and the pelvic floor.

Figure 5:
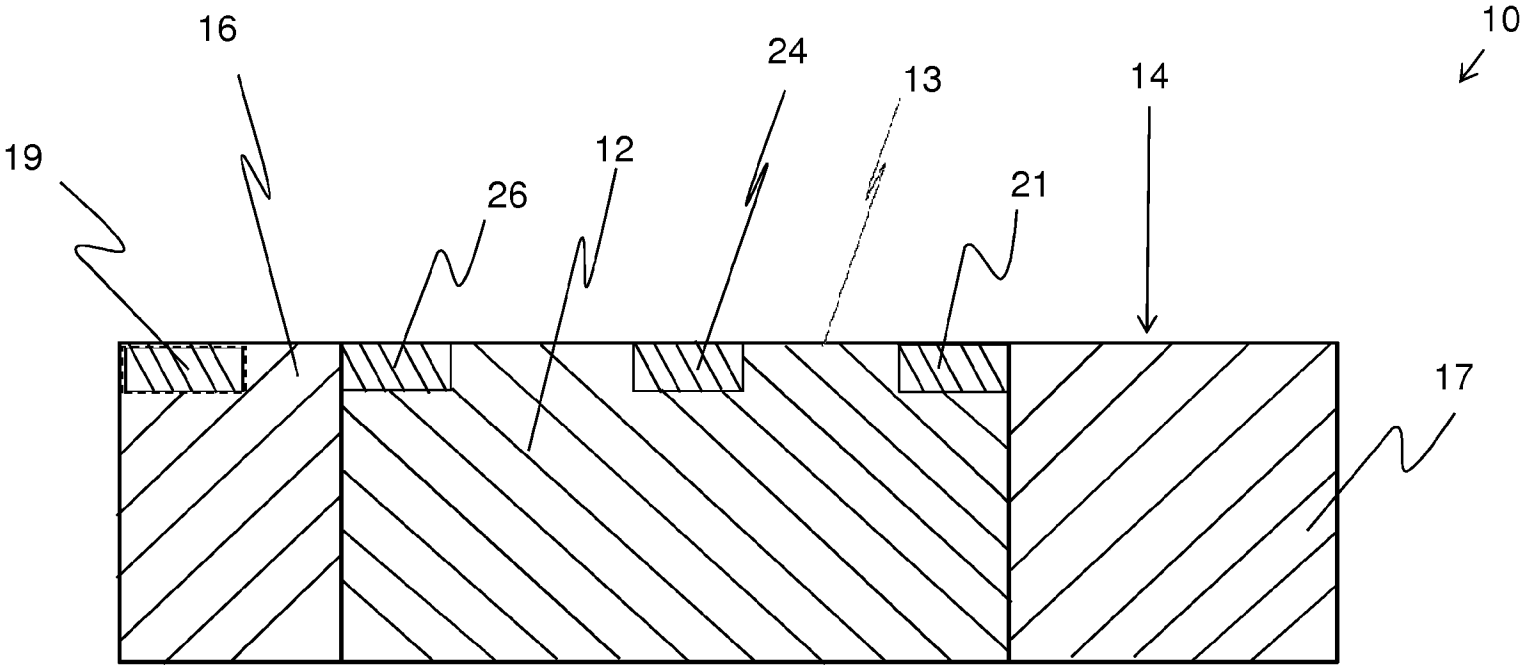
FIG. 5 is a cross section of an embodiment of the mattress of FIG. 1 taken along line A-A, where a base section has been removed.

The base section 18 is optional, and can have an appropriate depth, according to the patient's need. According to the embodiment shown in FIG. 5, the base section 18 is completely removed.

In one embodiment of the mattress 10, head support section 14, lower support section 16, and base support section 18 can be fabricated of firm foam, such as, but not limited to, a conventional white polyurethane-type foam, as known in the art, having a typical density of approximately 30-40 kg/cubic meter. Upper main section 12 can be fabricated from a visco-elastic memory foam, as known in the art, having a density of approximately 60-80 kg/cubic meter. The upper main section 12 is less firm than the lower support section 16, and the base support section 18. The higher firmness of the lower support section 16 is designed to increase support to the pelvis, while the abdomen is received by the upper main section 12. The upper main section 12 can be enclosed in a cotton cloth cover having elasticity, such as, but not limited to a cloth having 95% cotton and 5% Lycra® fibers. (The cloth cover is not shown in the figures.)

Alternatively or optionally, head support section 14, and lower support section 16 are fabricated of an inflatable, strong flexible plastic material (similar to that used in an inflatable mattress) with other sections fabricated and integrated and covered as noted hereinabove.

Figure 2:
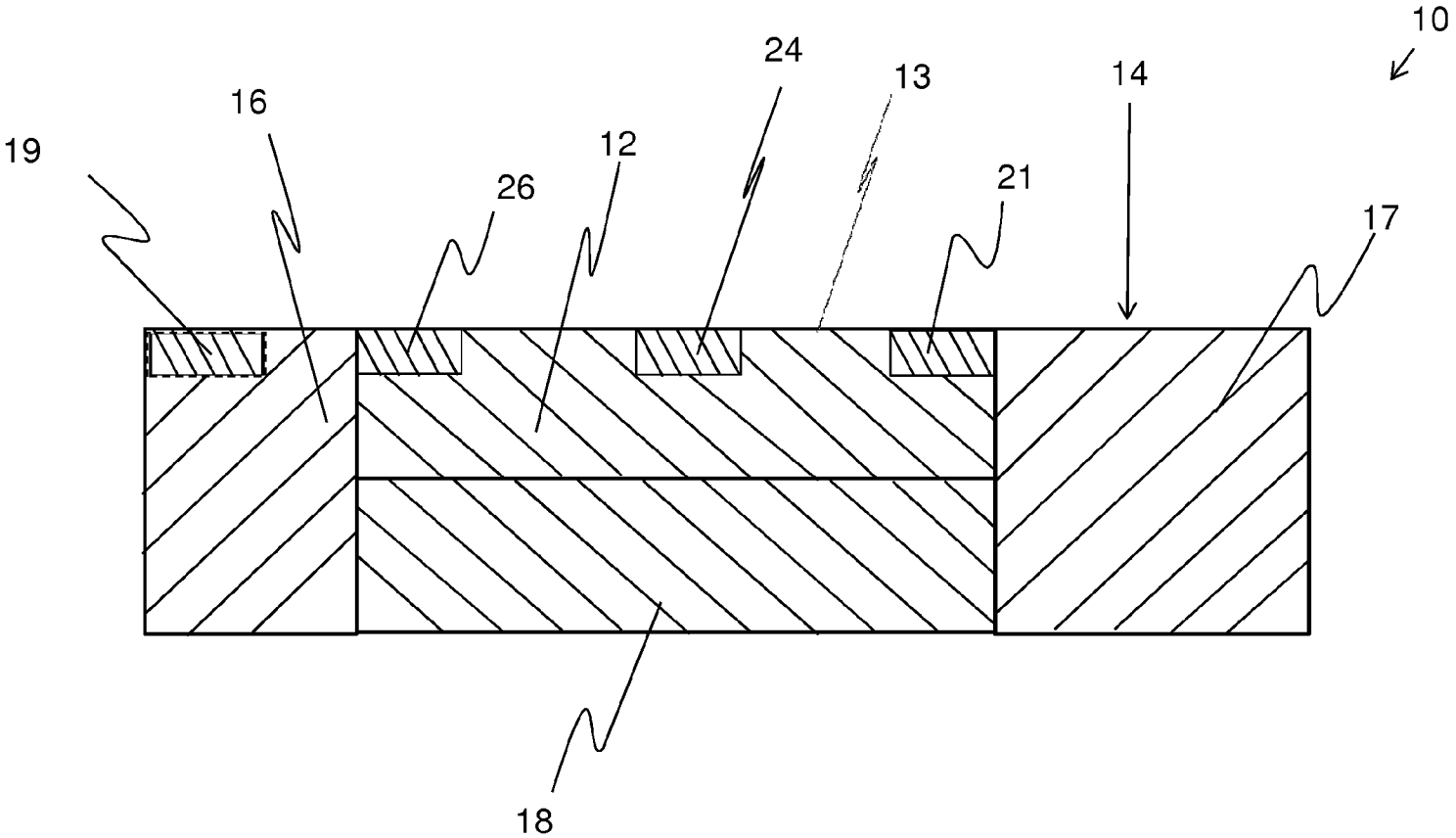
FIG. 2 is a cross section of the mattress of FIG. 1 taken along line A-A.

The mattress may be fabricated in different sizes (suited to different sizes of people) with the following approximate range of dimensions: 80-120 cm in length (meaning from the leftmost edge of a lower section 16 to the rightmost edge of head support section 14—ref FIG. 1); 20-25 cm in thickness (i.e. top to bottom of lower section 16 or of head support section 14—ref FIG. 2); and 50-60 cm in width (meaning the distance from edges of respective shoulder supporting members 21 and 22—ref FIG. 1). Additionally, head support section 14 typically measures about 30 cm in length; main section 12 approximately 50 cm in length; and lower section 16 about 20-30 cm in length. Head support section 14 may additional be fabricated in different shapes (not shown in the figures) which may be connected by adjustable strips (such as, but not limited to Velcro®).

Figure 3:
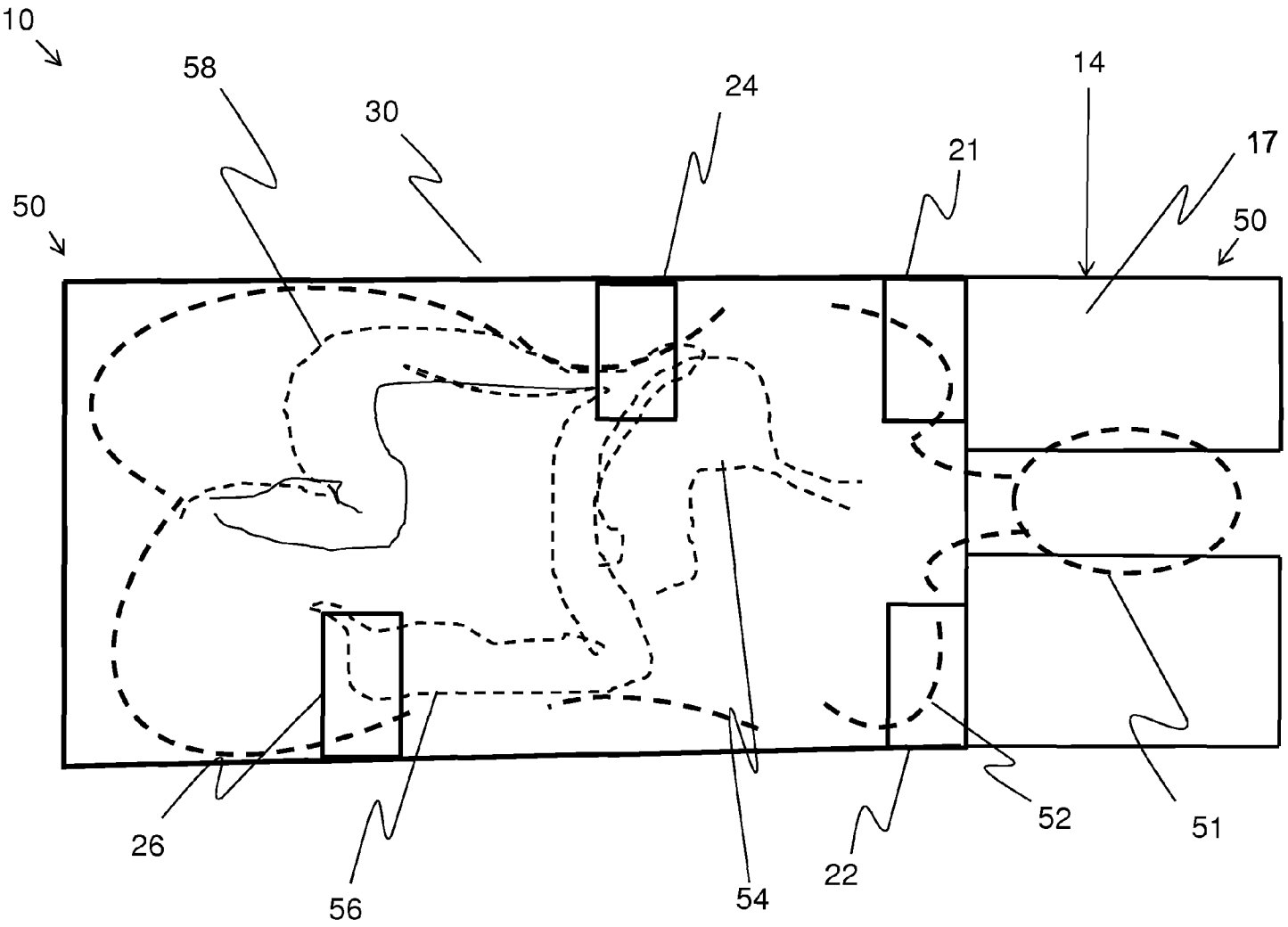
FIG. 3 is a schematic representation of a human body and some of its components projected onto the mattress shown in FIG. 1.

Reference is currently made to FIG. 3, which is a schematic representation of a human body 50 and some of its components projected onto the mattress 10 shown in FIG. 1, in accordance with embodiments of the current invention. Components of human body 50 include: a head 51; shoulders 52; and digestive tract components including: a stomach 54; a small intestine with Ileocecal valve (ICV) 56; and a large intestine 58. Apart from differences described below, the mattress 10 is identical in notation, configuration, and functionality to that shown in previous figures, and elements indicated by the same reference numerals and/or letters are generally identical in configuration, operation, and functionality as described hereinabove.

The mattress described hereinabove serves to introduce gentle support and backwards pressure on the shoulders (corresponding to shoulder supporting members 21 and 22 of the mattress).

Shoulder opening is an important issue in human body posture that allows for better breathing, avoiding neck and upper back stress. Most of modern life activities during the day activity are offering mainly slouching of the shoulders towards the chest in many situations like in sitting position that take place while working at a desk with computers, reading, driving, working at any office job, eating, watching entertainments of any kind and even lying at bad half sited watching TV while being supported by several pillows, as well as while doing some kind of sports in example, cycling or golf.

The support and backwards pressure noted hereinabove allow for the shoulders to open/expand in a gentle and gradual manner. In parallel, the brain, recognizing the shoulder opening, enables further shoulder opening. Shoulder opening occurs without any over-stretching or excessive pressure applied to the back and other body frame components. Shoulders opening is therefore important to teach the body different and better posture that prevents the pressure on the rib cage, on the back of the neck, and upon the upper back.

This important point is emphasized—that as physiological changes occur while the person remains in the prone position on the mattress; physiological changes are monitored by the brain. As the brain, recognizes physiological changes, the changes are further enabled by the brain.

In embodiments of the current invention, first intestinal supporting member 24 serves to support and press the stomach, creating a full stomach sensation. The sensation, combined with the local support of second intestinal supporting member 26, serve to induce a positive intestinal movement in a circular, clockwise direction, thereby encouraging movement in the small intestine. The mattress may be fabricated with additional dedicated supporting members—as necessary—to further enable support on specific organs and or areas and to create additional passive movement.

The mattress facilitates passive neural control/activity of the intestines by introducing a continuous pressure while the person breathes deeply. This activity is enabled during chest expansion (where deeper inhalation and belly breathing takes place, creating additional positive pressure on the digestive tract). At the same time, mechanical pressure is introduced in two organ positions, namely the stomach and the large intestine (corresponding to first intestinal supporting member 24) and the small intestine and ICV (corresponding to second intestinal supporting member 26). The pressure described hereinabove, in concert with physiological and mental changes contribute to better neural intestine functioning and to a passive "circulation" effect on the abdomen. The top portion of the mattress serves to support and contour to the shape of the body, enabling the body to have a sensation of floating—similar to floating in a swimming pool—as described further hereinbelow.

Additional advantages derived from the mattress described hereinbelow include, but are not limited to: stress relief to disks, ligaments, tendons, and muscles associated with improving proper back posture, and to torso and abdominal organs-in that spurious spinal-sensation related reactions are mitigated; thereby allowing healthy feedback and feed-forward neural controls to properly control respective organ functions.

Figure 4:
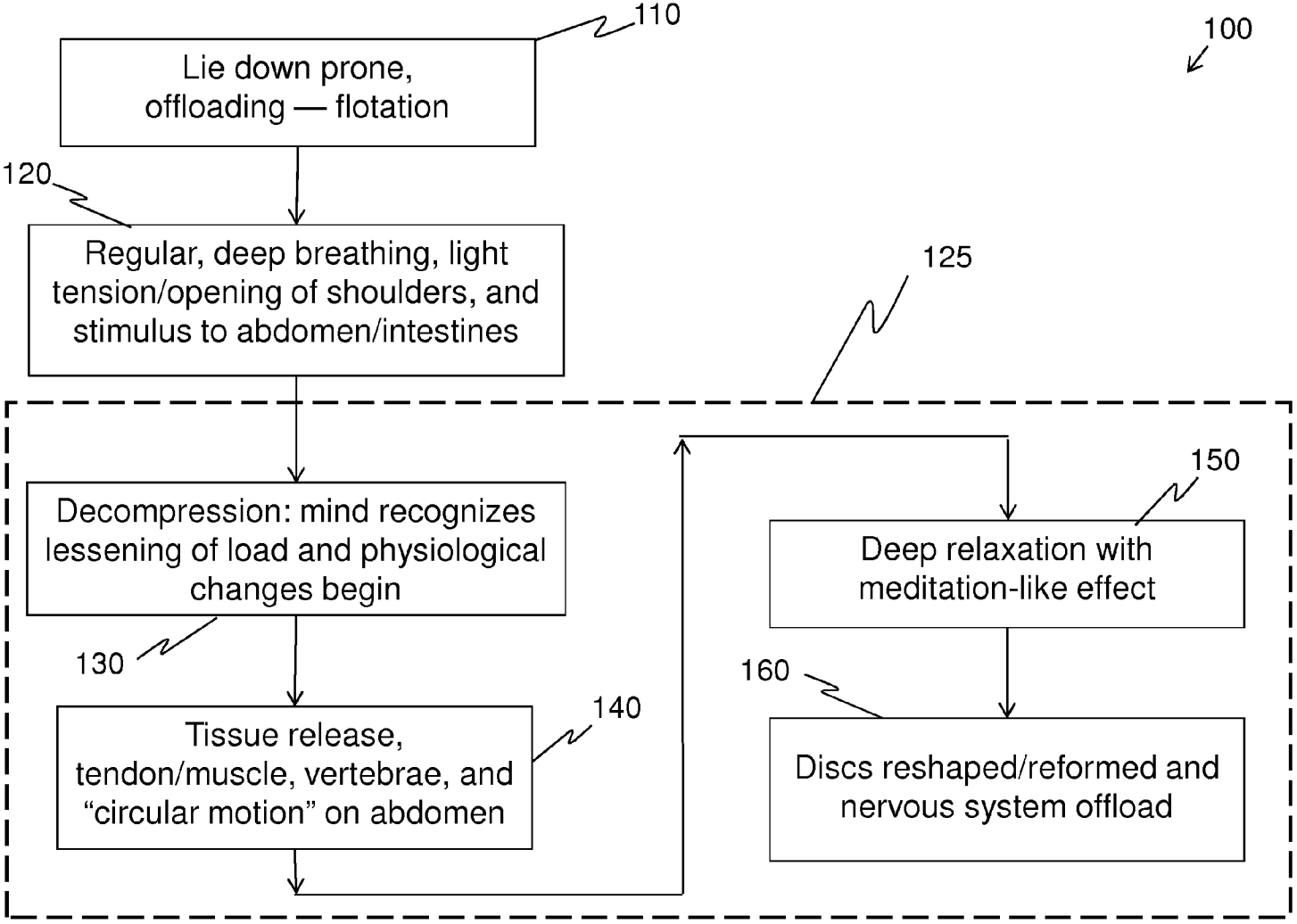
FIG. 4 is a flow chart showing a method of using the mattress of FIG. 1 for activating passive involuntary digestive tract movement.

Reference is currently made to FIG. 4, which is a flow chart, showing a method of using mattress 10 (of FIGS. 1-3) for activating passive involuntary digestive tract movement 100, in accordance with embodiments of the current invention. Apart from differences described below, mattress 10, also referred to hereinbelow as "the mattress", is identical in notation, configuration, and functionality to that shown in previous figures, and elements indicated by the same reference numerals and/or letters are generally identical in configuration, operation, and functionality as described hereinabove.

Method 100 is comprised of the steps of: lying prone on the mattress, 110; a continued support by the mattress with the onset of regular deep breathing, 120; and a series of physiological and conscious changes, 125, appearing as a result of continued support by the mattress. The series of physiological and conscious changes include the steps of: a decompression and mind recognizing lessening of load, 130; a tissue release, including, inter alia, tendon/muscle, vertebrae and introduction of a passive "circular motion" on the abdomen, 140; a deep relaxation with meditation-like effect, 150; and back discs reshaped/reformed and a general nervous system offload, 160.

Respective steps of method 100 are performed in a cumulative-time fashion, meaning that time durations and time ranges indicated hereinbelow are all measured from a shared "start time", meaning the time when lying on the mattress has commenced.

Included in step 110 is a general sensation of the spine floating, such as that experienced in a swimming pool floating position, with minimal gravitational pressure on the diaphragm. Step 110 typically takes place in the approximate range of 1-3 minutes from the start time.

Included in step 120, which typically takes place in the approximate range of 3-6 minutes from the start time, is continued face-down relaxation on the mattress and the neck shoulders being supported/constrained from rotation, yielding a reduction of stress off the upper back, enabling the nervous system to operate more freely—setting up processes that occur in step 130, as described hereinbelow.

In step 130, as vertebrae and neck/shoulders experience decompression, the nervous system (including the brain/mind) recognizes the lessening of load first experienced in step 120. Step 130 typically takes place in the approximate range of 6-10 minutes from the start time.

Step 140, taking place in the approximate range of 10-20 minutes from the start time, includes controlled relaxation of the ligaments, tendons and muscles, enabled, controlled and supervised by the brain in accordance with the back system status.

Step 150 includes an induced meditation-like relaxation which enables step 160, which includes rejuvenation of the discs and natural repair and healing of scared tissues. Step 150 typically takes place in the approximate range of 20-25 from the start time. Step 160 typically takes place in the approximate range of 25-35 minutes from the start time and includes gradual improvements and improved physical changes on the long term. Method 100, as described above, includes lying prone on the mattress for a total time of approximately 35 minutes—a time period that is conducive with many therapeutic/relaxation procedures performed as frequently as once daily.

Other advantages of continued prone lying on the mattress, in accordance with embodiments of the current invention include:

a. opening of the chest cavity with posterior extension of the shoulders; by the upper support members 21,22
b. slight extension stretch of the pelvis and lower back and release of thigh and buttocks muscles; by the lower member 16
c. enabling constant rhythmic belly breathing, influencing and activating the upper and lower back vertebrae and increase flexibility; by lower member 16, and central member 12
d. breathing against equal force to the body weight, relaxing the chest girdle and activating rib muscles and diaphragm, increasing functionality of the intestines by applying soft pressure in the region of the stomach and the lower right abdomen; by lower member 16, and central member 12, by the upper support members 21,22 and members 24, 26; and
e. enhanced, deeper and slower breathing, up to the point of meditation and deep sleep in a relaxed and floating state.

Additionally, sleeping for approximately 30-60 minutes on the mattress—at least a few times a week—can serve to compensate for a loss of sleeping hours and to creating a feeling of refreshment and increased vitality. This unique sleeping posture is maintained in total relaxation, meditation, deep slow breathing, and with no pressure on the skeleton. Lying on the mattress for 20-30 minutes before bedtime enables a better night's sleep without unnecessary stresses on the skeletal system that can interrupt restful and proper sleep, and thus enabling the brain and spinal/nervous system to function better.

It will be appreciated that the above descriptions are intended only to serve as examples, and that many other embodiments are possible within the scope of the present invention as defined in the appended claims.

What is claimed is:

1. An enhanced mattress (10) configured for enabling passive involuntary digestive tract movement, shoulder opening and pelvis bones movement, the mattress (10) being configured solely for prone lying of a human body thereupon and comprising: a head support section (14) configured to support a head of the human body, the head support section (14) comprising an open face section; an upper main section (12) connected to the head support section (14), the upper main section (12) configured to support shoulders and an abdomen of the human body, the upper main section (12) comprising a plurality of dedicated supporting members, each being smaller than the upper main section (12) and having a greater firmness therefrom; a lower support section (16) connected to the upper main section (12), the lower support section (16) configured to support a pelvis of the human body; wherein the plurality of dedicated supporting members comprises: two shoulder supporting members (21, 22) located adjacent a top terminal edge connecting the upper main section (12) and the head support section (14) and located directly across from each other, along a direction perpendicular to a longitudinal direction of the mattress, the shoulder supporting members (21, 22) configured to correspond with the shoulders and to bias the shoulders backwards, in a direction away from the mattress (10); a first intestinal supporting member (24) positioned approximately at a center of the length of the mattress (10) and configured to compress and correspond with a stomach and small and large intestine area of the body: and a second intestinal supporting member (26) located between the center and a bottom terminal edge opposite the top terminal edge, the second intestinal supporting member (26) configured to compress and correspond with an Ileocecal valve (ICV) in the large intestine area of the body.

2. The mattress (10) according to claim 1, wherein at least the head support section, upper main section, lower support section, and the plurality of dedicated supporting members form a substantially continuous mattress.

3. The mattress (10) according to claim 1, wherein the first intestinal supporting member (24) is located diagonally opposite the second intestinal support member (26) in the upper main section (12).

4. The mattress (10) according to claim 1, wherein the first intestinal support member (24) is configured to support and press the stomach area and a transverse intestine curve to a descending intestine and to create a full stomach sensation, and induce a positive intestinal movement in a circular clockwise direction, the second intestinal support member (26) is configured to induce a positive intestinal movement in a circular clockwise direction.

5. The mattress (10) according to claim 1, wherein the head support section (14) and lower support section (16) are fabricated from foam having a density ranging substantially from 30-40 kg/cubic meter.

6. The mattress (10) according to claim 1, wherein the upper main section (12) is fabricated from visco-elastic memory foam having a density ranging from 60-80 kg/cubic meter.

7. The mattress (10) according to claim 1, wherein the supporting members (21, 22, 24, and 26) have a density of 30-40 kg/cubic meter.

8. The mattress (10) according to claim 1, wherein the supporting members (21, 22, 24, and 26), have a polygonal shape.

9. The mattress (10) according to claim 1, wherein the lower support section (16) has a greater firmness than the upper main section (12).

10. The mattress (10) according to claim 1, wherein the mattress (10) comprises a base section (18) which is positioned beneath, and configured to support, the upper main section (12), the base section has a greater firmness than the upper main section (12).

11. The mattress (10) according to claim 10, wherein the base section (18) is fabricated from foam having a density ranging substantially from 30-40 kg/cubic meter.

12. The mattress (10) according to claim 1, wherein the head support section (14) comprises two cushioning members (17) located at two sides of the head opening (15), the cushioning members (17) extend away from the upper main section (12).

13. The mattress (10) according to claim 1, wherein the lower support section (16) comprises a relief member (19) which has a lower firmness than the rest of the lower support section (16), the relief member (19) is located at the middle of the lower support section (16) in a width direction.

14. The mattress (10) according to claim 13, wherein the relief member (19) is made of a visco-elastic material.

15. An enhanced mattress (10) configured for enabling passive involuntary digestive tract movement, shoulder opening and pelvis bones movement, the mattress (10) being configured solely for prone lying of a human body thereupon and comprising: a head support section (14) configured to support a head of the human body, the head support section (14) comprising an open face section; an upper main section (12) connected to the head support section (14), the upper main section (12) having a rectangular shape in a plan view thereof, and configured to support shoulders and an abdomen of the human body, the upper main section (12) comprising a plurality of dedicated supporting members, each being smaller than the upper main section (12) and having a greater firmness therefrom; and a lower support section (16) connected to the upper main section (12), the lower support section (16) configured to support a pelvis of the human body wherein the plurality of dedicated supporting members comprises: two shoulder supporting members (21, 22) configured to correspond with the shoulders and to bias the shoulders backwards, in a direction away from the mattress (10); a first intestinal supporting member (24) positioned approximately midway between a top terminal edge connecting the upper main section (12) and the head support section (14) and a bottom terminal edge connecting the upper main section (12) and the lower support section (12) and configured to compress and correspond with a stomach and small and large intestine area of the body; and a second intestinal supporting member (26) configured to compress and correspond with an ICV in the large intestine area of the body; and wherein the two shoulder supporting members (21, 22) are located at two respective corners of the rectangular shape of the upper main section which are closest to the head support section (14) and the second intestinal supporting member (26) is located diagonally across from the shoulder supporting member (21), at a respective corner of the upper main section farthest from the head support section (14).

* * * * *